US005847503A

United States Patent [19]

Roussel et al.

[11] Patent Number: 5,847,503

[45] Date of Patent: Dec. 8, 1998

[54] ELECTRON BEAM DEFLECTION DEVICE FOR CATHODE RAY TUBES WHICH IS SELF CONVERGENT AND GEOMETRY CORRECTED

[75] Inventors: Bruno Francis Roussel; Alain Dumesnil, both of Genlis, France

[73] Assignee: Thomson Tubes & Displays S.A., Boulogne, Cedex, France

[21] Appl. No.: 942,525

[22] Filed: Oct. 2, 1997

Related U.S. Application Data

[63] Continuation of Ser. No. 313,315, Sep. 24, 1996, abandoned.

[51] Int. Cl.[6] ..... H01J 29/70; H01F 07/00; H01H 01/00; H01H 05/00

[52] U.S. Cl. ..... 313/440; 313/426; 313/430; 335/210; 335/213; 335/297; 335/299

[58] Field of Search ..... 313/440, 412–413, 313/421, 429, 426, 430–431, 433, 441–442; 335/210, 213, 297, 299

[56] References Cited

U.S. PATENT DOCUMENTS

| | | | |
|---|---|---|---|
| 4,433,318 | 2/1984 | Okuyama et al. | 313/421 X |
| 4,464,643 | 8/1984 | Meershoek | 335/213 |
| 4,556,857 | 12/1985 | Logan | 335/210 |
| 4,882,521 | 11/1989 | Arimoto | 313/440 |
| 4,992,697 | 2/1991 | Penninga et al. | 313/440 |
| 5,077,533 | 12/1991 | Klingelhofer | 335/213 |
| 5,115,170 | 5/1992 | Ose et al. | 335/213 X |
| 5,119,056 | 6/1992 | Itoh et al. | 335/213 |
| 5,166,576 | 11/1992 | Roussel et al. | 313/440 X |
| 5,399,334 | 3/1995 | Zegers | 313/431 X |
| 5,436,536 | 7/1995 | Van Der Wilk et al. | 335/213 X |
| 5,506,469 | 4/1996 | Vink et al. | 313/440 |
| 5,519,281 | 5/1996 | Jamar | 313/413 |

FOREIGN PATENT DOCUMENTS 2010006 6/1979 United Kingdom .

OTHER PUBLICATIONS

*Proceedings of the SID*, vol. 26, No. 1, 1985, Los Angeles USA, Dasgupta "Relationship Between Raster Distortions, Screen Geometry and Winding Distribution of Deflection Yoke in a CRT Display System", pp. 37–40.

*Primary Examiner*—Sandra O'Shea
*Assistant Examiner*—Mark Haynes
*Attorney, Agent, or Firm*—Joseph S. Tripoli; Joseph J. Laks; Jean K. Testa

[57] ABSTRACT

A deflection device for a cathode-ray tube with three coplanar guns, comprising a pair of horizontal deflection coils and a pair of vertical deflection coils, each horizontal deflection coil having a main deflection winding extending over the length of the deflection device, and an auxiliary deflection winding. Each main deflection winding has a front portion and a rear portion. The auxiliary deflection winding is disposed in the front portion of the main deflection winding and is arranged to generate a magnetic field opposed to a field of the main deflection winding. Each of the auxiliary windings has conductors arranged laterally about a mean angle from a horizontal deflection axis, the mean angle varying as a function of the position of the conductors along a longitudinal axis of the deflection device such that, in the front portion of each of the main deflection windings of the pair of horizontal deflection coils, an amplitude of the third-order harmonic of the Fourier series decomposition of the angular distribution of the ampere-turn density is substantially equal to or greater than that of the fundamental.

8 Claims, 6 Drawing Sheets

ELECTRON BEAM DEFLECTION DEVICE FOR CATHODE RAY TUBES WHICH IS SELF CONVERGENT AND GEOMETRY CORRECTED

This is a continuation of application Ser. No. 08/313,315, now abandoned, filed Sep. 24, 1996.

BACKGROUND OF THE INVENTION

The present invention relates to a device for deflecting electron beams given off by an electron gun with three in-line beams of a cathode-ray tube including a substantially flat screen panel.

In cathode-ray tubes using an electron gun with three coplanar beams corresponding to the three primary colours Red, Green, Blue, the deflection device, also called yoke, has the function of deflecting the beams in such a way as to make them explore the whole surface of the screen of the tube in order there to generate the images and to ensure convergence of these beams throughout the exploration.

Under the action of uniform horizontal and vertical deflection fields, the volume swept by the electron beams is a pyramid, the vertex of which is coincident with the centre of deflection of the deflection device and the intersection of which with a screen surface of large radius of curvature determines a figure exhibiting a geometry defect called pincushion defect. This geometric distortion of the image is all the greater the larger the radius of curvature of the screen of the tube.

The so-called self-convergrent yokes generates astigmatic line and frame magnetic fields so as to ensure convergence of the electron beams at the site of the perforations formed in the colour selection mask arranged at a very short distance from the screen of the tube. The lines of force of the magnetic fields created must then be pin-cushion-shaped for the line field and barrel-shaped for the frame field.

These magnetic fields modify the NORTH/SOUTH and EAST/WEST geometry of the image, in particular by exerting compensation for the NORTH/SOUTH pincushion distortion due to the flatness of the screen.

It is known, in order to correct for the residual geometry distortions, to use metal parts extending to the front of the deflection device as in the Toshiba U.S. Pat. No. 4,257,023, or a series of oriented magnets arranged on the deflection device or in proximity to it, as described in the Videocolor Patent FR 87-02370, or to invert the direction of flow of the current in a part of the line winding as in the Patent FR 2,411,486. However, none of these devices makes it possible to control the WORTH/SOUTH geometry of the image over the whole surface of a substantially flat screen while preserving the convergence of the beams over the whole of its surface.

SUMMARY OF THE INVENTION

The object of the present invention is to minimize the NORTH/SOUTH geometry distortion generated by a substantially flat screen while preserving the convergence of the electron beams.

The deflection device for a cathode-ray tube with three coplanar guns, in accordance with the present invention, comprises a pair of horizontal deflection coils and a pair of vertical deflection coils, each horizontal deflection coil being characterized in that the angular distribution of the ampere-turn density in the said coil changes sign at at least one point in a region limited to the front part of this coil.

BRIEF DESCRIPTION OF DRAWINGS

The invention will be better understood with the aid of the figures below, among which.

DETAILED DESCRIPTION

It is usual to divide the deflection system into three successive action regions along the Z axis; the rear region, closest to the electron gun, more particularly influences the coma or difference in size of the green image with respect to the blue and red images; the middle region of the deflector acts more particularly on the astigmatism or the convergence of the red and blue electron beams; finally, the front region, situated closest to the screen of the tube, acts on the geometry of the image which will be formed on the screen.

Figure 1:
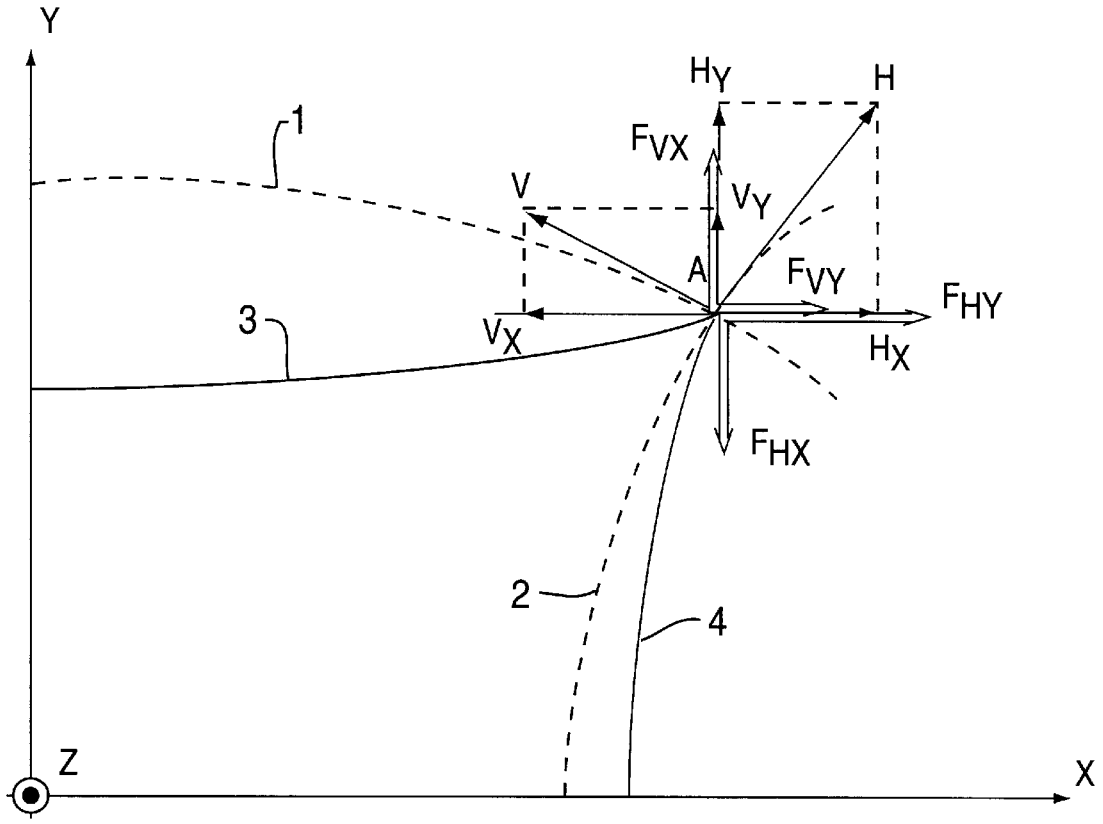
FIG. 1 shows a section, through a plane perpendicular to the longitudinal axis Z of the tube and situated to the front of the deflector, on the screen side, of the pyramidal deflection volume; the horizontal and vertical magnetic fields are represented there, as are the forces being exerted on the electrons which will form the upper right corner of the image.

FIG. 1 shows the action of the lines of force of the horizontal deflection magnetic field 1, along the direction of X axis and of the vertical deflection magnetic field 2, along the direction of the Y axis, on the geometry of the image. On the figure are represented, at A, the electron beam corresponding to the upper right corner of the image and, at 3 and 4, the electron beans corresponding to the edges of the image. By breaking down the magnetic fields and the forces which they create on the electron beams, it is seen that these forces (FVy and FHx), originating from the pincushion shape of the line field and barrel shape of the frame field, have a tendency to pull on the point A in such a way as to correct the horizontal (NORTH/SOUTH) pincushion distortion and to amplify the vertical pincushion distortion.

In order for the line deflection field to have a pincushion-shaped distribution, it is necessary for the distribution of the turns of the line coil to be such that the Fourier series decomposition of the angular distribution of the ampere-turn density in the coil causes the appearance of a 3rd-harmonic percentage which is not inconsiderable with respect to the fundamental.

Figure 2:
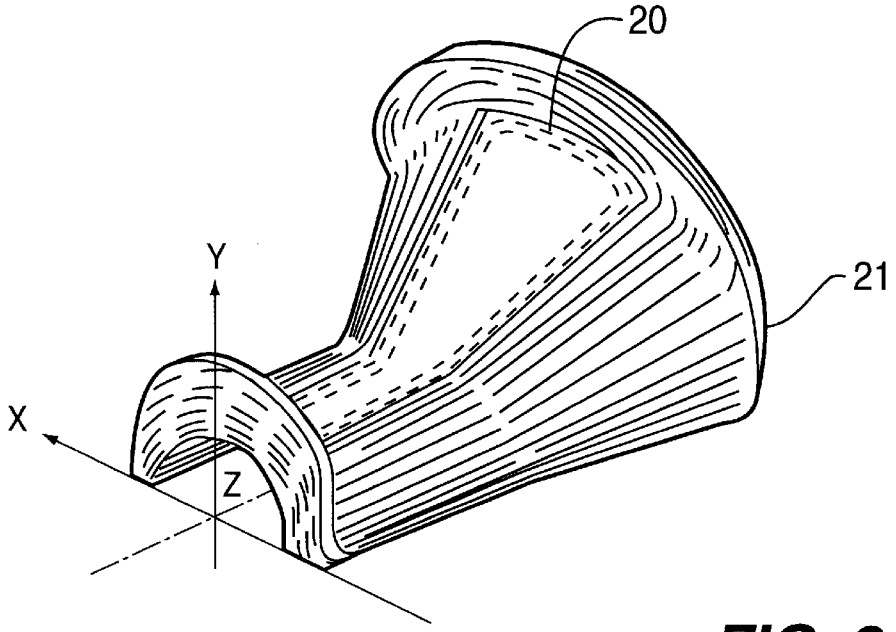
FIG. 2 is a view in perspective of a saddle-shaped line coil of a known deflection device.
Figure 4:
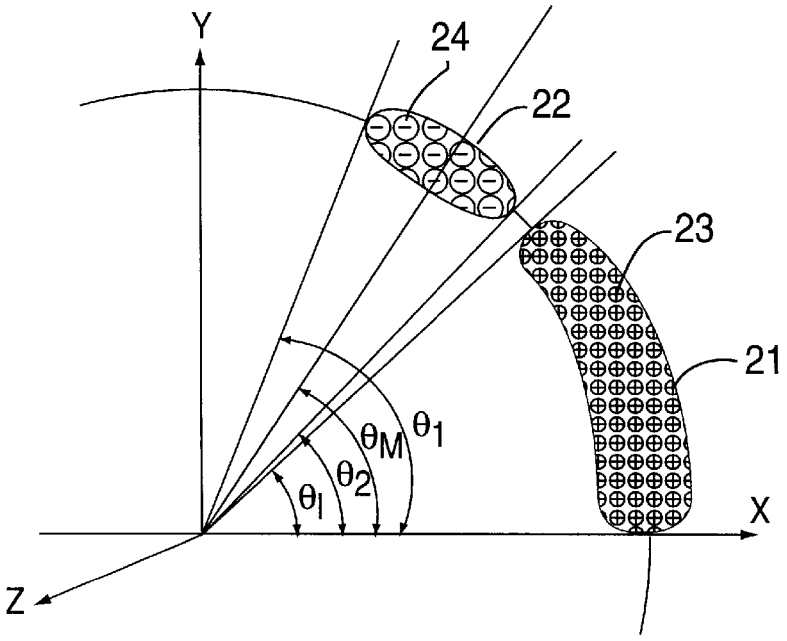
FIG. 4 is a sectional view in a plane perpendicular to the main axis Z of the tube, of the front part of a saddle-shaped coil in accordance with the present invention.

It is known, in order to increase the 3rd harmonic percentage, that the wire conductors of the coil 21, visible in FIG. 2, extending in the direction of the main Z axis, have to be packed as close as possible to the XZ plane. As FIG. 2 shows, representing a saddle-shaped line coil 21 seen in perspective, and as FIG. 4 shows, representing a coil of this type seen in section in a plane perpendicular to the Z axis, the lateral conductors 23 of the coil 21 meeting the criterion sought are contained in an angular aperture θ1 which is as small as possible. Whereas it is possible to achieve convergence of the beams by such a distribution, correcting the NORTH/SOUTH geometry for a tube having a screen of slight curvature, or even completely flat, is then impossible; physical limitations due to the size of the wires do not make it possible to reach the values of 1 which are required to obtain a suitable 3rd-harmonic ratio. In particular, it is impossible to obtain a 3rd-harmonic coefficient close to or greater than that of the fundamental. Moreover, it is known that this coil structure introduces a significant 5th-harmonic percentage, responsible for the deconvergence of the electron beams in the corners of the screen.

The French Patent FR 2,411,486 describes a coil, represented in FIG. 2, in which the direction of the current is reversed in a part 20 (in dashed lines in the figure) of the winding 21. This structure makes it possible to increase the 3rd-harmonic part, but also causes overconvergence of the electron beams if this part is very large, as is the case when it is a question of correcting the geometry of a screen with a large radius of curvature; moreover, the turns 20 reduce the inductance to resistance (L/R) ratio between the value of the inductance of the coil 21 and its resistance, which has the consequence of increasing the power supplied necessary for scanning of the screen.

Figure 3:
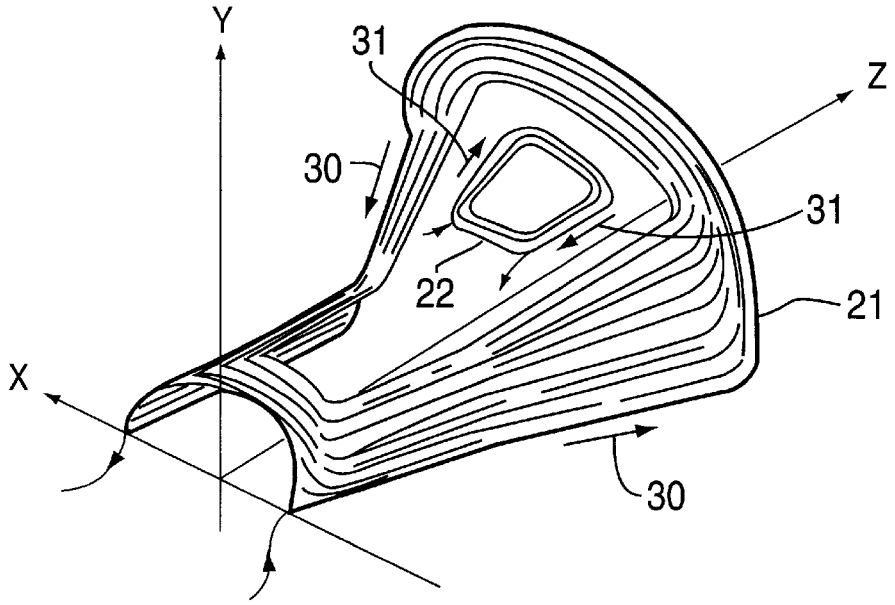
FIG. 3 is a view in perspective of a saddle-shaped line coil in accordance with the present invention.

The device of FIG. 3 describes an embodiment of the present invention: the line deflection coil consists of a winding in two parts:

a main deflection coil extending over the length of the yoke along the Z axis, and the lateral conductors of which are packed as close as possible to the XZ plane an auxiliary deflection winding arranged in the front part of the main coil and fed in such a way as to generate a field of direction opposed to the direction of the field created by the main winding.

FIG. 4 is a sectional view along a plane perpendicular to the main Z axis of the tube, of the front part of a saddle-shaped coil in accordance with the invention having regard to the symmetry along the Y axis, only the section of one half-coil is represented. This half-coil comprises a first part constituting a main coil 21, the conductors 23 of which are fed in such a way that the current which passes through it flows in a certain direction 30, as seen in FIG. 3, and a second part 22, constituting an auxiliary coil situated to the front of the yoke, fed in such a way that the current, in the conductors 24 flows there in a direction 31, as seen in FIG. 3, the reverse of the preceding one.

The conductors 24 are arranged in such a way that they occupy an angular aperture $(\theta_1-\theta_2)$ and are distributed about a mean angle $\theta_m$, on either side of which there is a substantially equal number of conductors 24.

The principle of the invention will be better understood by writing the equations which govern magnetic deflections. Due to the symmetries in the windings of the yoke, the Fourier series decomposition of the ampere-turn density N(θ) of a coil is expressed as:

$$N(\theta) = A1 \cdot \mathrm{COS}(\theta) + A3 \cdot \mathrm{COS}(3\theta) + A5 \cdot \mathrm{COS}(5\theta) + \ldots + AK \cdot \mathrm{COS}(K\theta) + \ldots$$

$$\text{with } AK = (4/\pi) \cdot \int_{\theta}^{\pi/2} N(\theta) \cdot \mathrm{COS}(K\theta) \cdot de$$

The magnetic field created is given by the expression:

$$H = A1/R + (A3/R^3)\cdot(X^2-Y^2) + (A5/R^5)\cdot(X+4-6\cdot X^2\cdot Y^2+Y^4) + \ldots$$

where R is the radius of the ferrite magnetic circuit which covers the deflection coils so as to concentrate the fields in order to enhance the energy efficiency of the deflection device and A1/R represents the fundamental field, $(\mathbf{A3}/R^3)\cdot(X^2-Y^2)$ the 2nd harmonic of the field, and $(\mathbf{A5}/R^5)\cdot(X^4-6\cdot X^2\cdot Y^2+Y^4)$, the 4th harmonic of this field, etc.

Thus, a positive A3 term corresponds to a positive field 2nd harmonic and induces pincushion-field lines of force.

Figure 5:
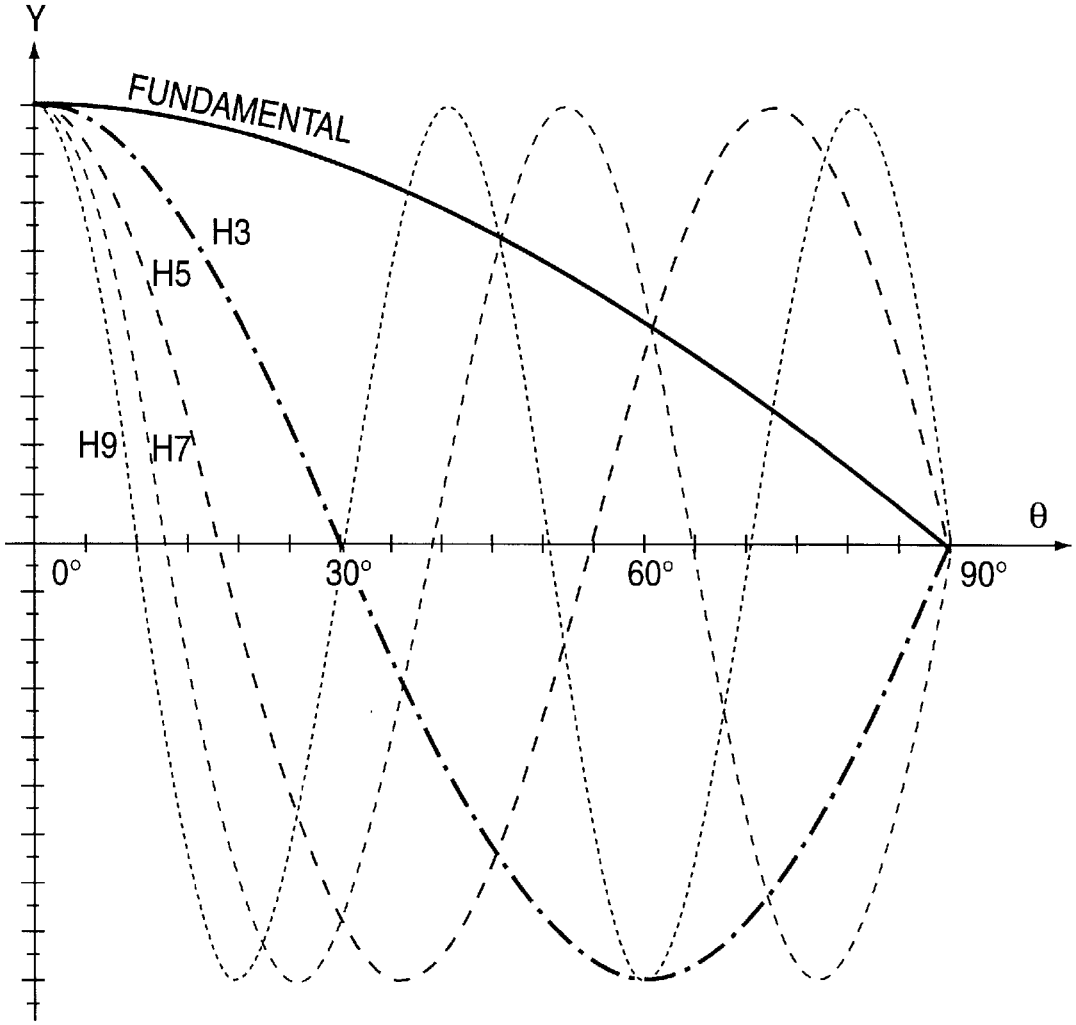
FIG. 5 illustrates the angular variation between 0° and 90° of the functions cos θ, cos 3θ, cos 5θ, etc., of the distribution function of the ampere-turn density in a deflection coil.

In this context, FIG. 5 represents the terms COS (θ), cos (3θ), COS (5θ), etc., as a function of θ, for θ lying between 0° and 90°.

For positive N(θ), as in the case of the main coil, the A3 term is positive if the conductors constituting the winding are arranged between θ=0° and θ=30°, values for which COS (3θ) is positive. In order to have a very high 3rd-harmonic ratio created by the main winding, the conductors constituting it will preferably be arranged between 0° and 20°, for which values COS (3θ) remains greater than 0.5. It is possible to increase the 3rd-harmonic proportion by reversing the direction of the current in the auxiliary winding; N(θ) becomes negative and A3 remains positive if cos (3θ) is negative; in this way, it is thus possible to introduce some positive 3rd harmonic by winding conductors in the opposite direction in an angular position lying between 30° and 90°. A mean angular position $\theta_M$ of the conductors 24 will preferably be chosen, at least in the front part of the coil 22, between 55° and 65°, so that this coil has a maximum influence in this region on the 3rd harmonic, since, in this region, COS (3θ) is very clone to −1.

The angular situation of the conductors of the main coil, between 0° and 20°, introduces a significant percentage of 5th harmonic of the ampere-turn density which it is possible to compensate for by the auxiliary winding by placing the conductors 24 in a region where N(θ)·COS (5θ) is negative (so as to be subtracted from the 5th harmonic introduced by the main coil), which for negative N(θ) can be achieved by arranging the majority of the conductors 24 in an angular position lying between 54° and 90°.

In the same way it is possible to compensate for the influence of the higher harmonics introduced by the main winding by an appropriate arrangement of the conductors 24.

Finally, if necessary, it is possible to adjust the percentage of the various harmonics with respect to the fundamental by varying the mean angular position $\theta_M$ and/or the angular aperture $(\theta_1-\theta_2)$ of the conductors 24 as a function of the position along the Z axis. In particular, in order to obtain a less pronounced action by the winding 22 on the 3rd-harmonic ratio in the part furthest from the screen, in order to avoid overconvergence of the electron beams, the mean angular position $\theta_M$ increases in proportion to the distance from the screen.

This coil structure further makes it possible to limit the reduction in the L/R ratio of the horizontal deflection coil to acceptable values, since, in this case, the conductors 24 occupy a smaller surface area than the conductors 20 of the state of the art.

Figure 7:
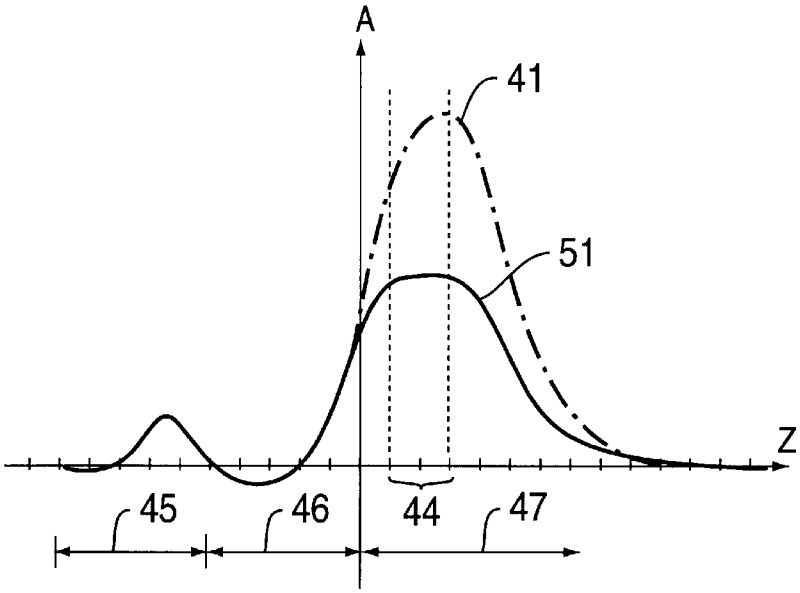
FIG. 7 shows the influence on the 2nd harmonic of the magnetic field of a coil structure in accordance with the invention.
Figure 8:
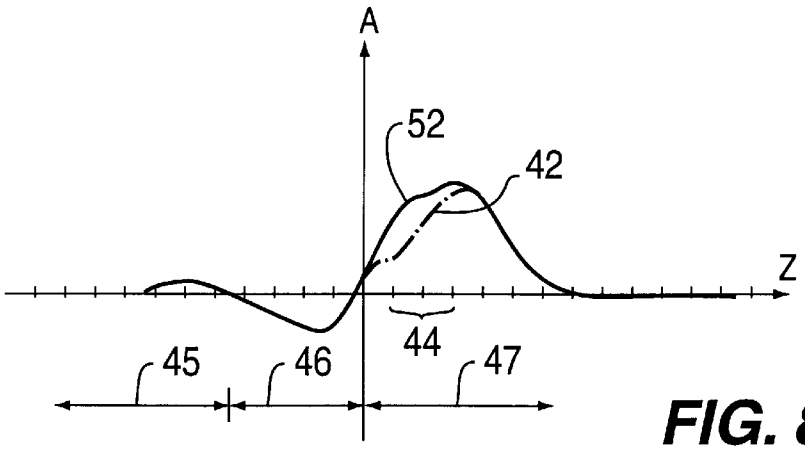
FIG. 8 shows the influence on the 4th harmonic of the magnetic field of a coil structure in accordance with the present invention.
Figure 6:
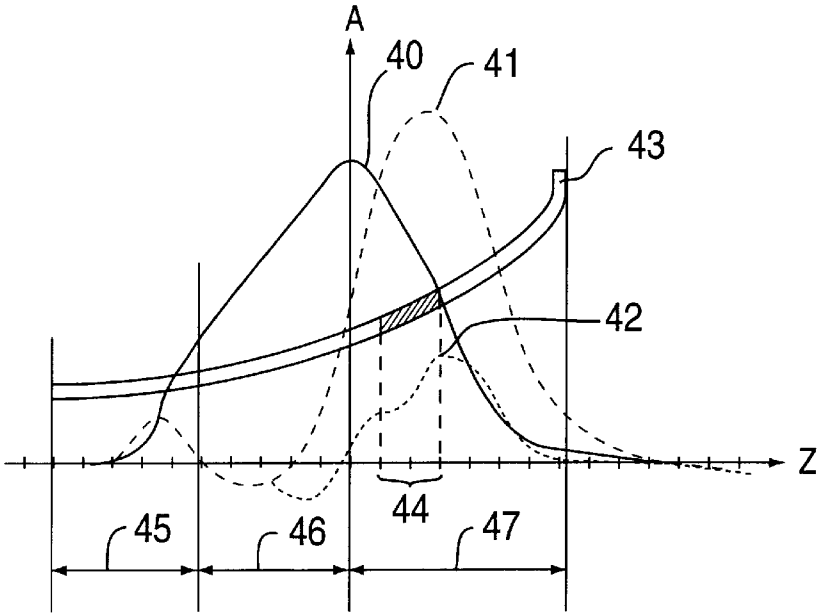
FIG. 6 represents the results of amplitude measurements of magnetic fields along the Z axis which are created by a line coil in accordance with the present invention.

In one embodiment of the invention, intended to equip a tube manufactured by the ZENITH company, with a flat screen of about 40 cm diagonal, the auxiliary winding is arranged in the front third of the main winding. The winding 21 extends, in Z, over a length of about 90 mm and includes 32 turns whereas the winding 22 extends along Z over a length of 20 mm and includes 14 turns. The two windings are arranged in series, in such a way that the current in the auxiliary winding flows in the opposite direction to the current in the main winding. The series arrangement of the two windings is not limiting, the winding 22 possibly being fed, in an obvious way, by a second, external source. The conductors 24 are arranged about an angular position $\theta_M$ lying between 58° and 71°, increasing in proportion with distance from the part of the winding which is closest to the screen of the tube, the conductors 24 being wound between 54° and 80°. Referring to FIG. 6, the deflection device being thus divided into three regions the front region 47, the closest to the screen of the tube, the mid-region 46, and the rear region 45. FIGS. 6, 7, 8 represent, along the Z axis, the modifications to the amplitude of the line field of the yoke 43 which are introduced by the auxiliary coil positioned at 44 in the front part 47 of the main winding, that is to say closest to the screen of the tube. Referring to FIG. 7, the amplitude of the 3rd harmonic is approximately doubled, from 51 without the coil 22 to 41 after addition of this coil; thus the amplitude 41 of the 3rd harmonic obtained is again greater than that 40 of the fundamental by about 12%. Referring to FIG. 8, in the region of action 44 of the auxiliary winding, the amplitude of the 5th harmonic is reduced from 52 to 42, thereby enhancing the convergence of the beams in the corners of the screen.

Figure 9A:
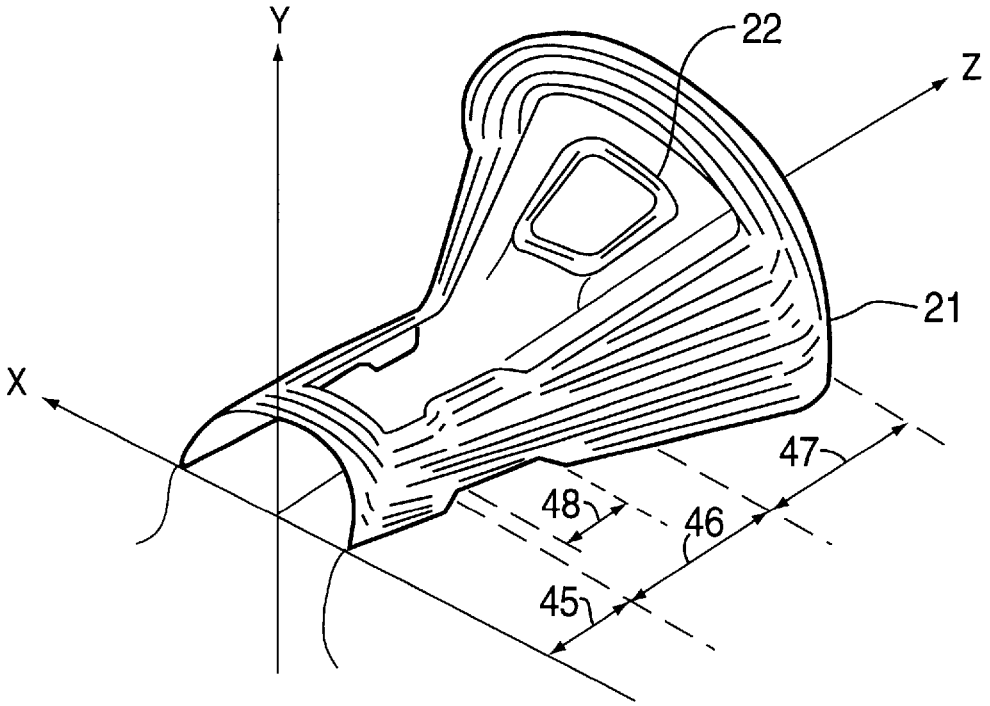
FIGS. 9 and 10 illustrate variants of the present invention.
Figure 9B:
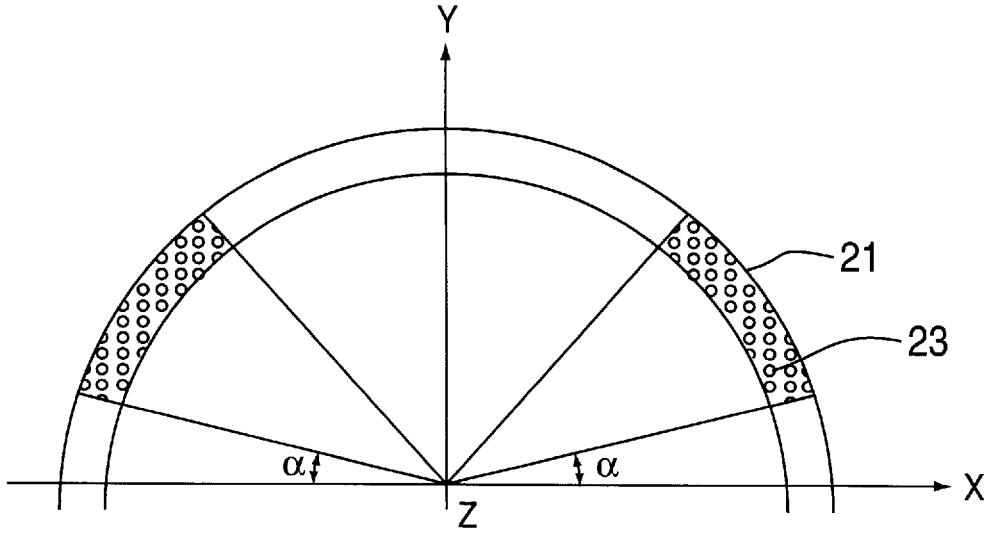

In one advantageous embodiment, some of the conductors 23 of the main winding 21, situated in the mid-part 46 of the yoke, are offset inwards on the coil 21 over a length 48. FIGS. 9A and 9B illustrate this embodiment, showing a line coil in which the conductors as a whole are offset inwards on the coil. In a sectional view in a plane perpendicular to Z passing through the region 48, this offset is represented by the angle $\alpha$. This offset makes it possible, in the region 46, locally to reduce the magnitude of the 3rd harmonic of the angular distribution of the ampere-turn density in the winding, an excessive value of which could entail deconvergence of the electron beans, but which it is necessary to have in region 47 in order to be able to obtain an effective correction of the pincushion distortion. Adapted to the flat-screen ZENITH tube of 40 cm diagonal, the conductors of the coil 21 of the yoke equipping this tube are offset by an angle equal to about 10% in the mid-region 46.

Figure 10:
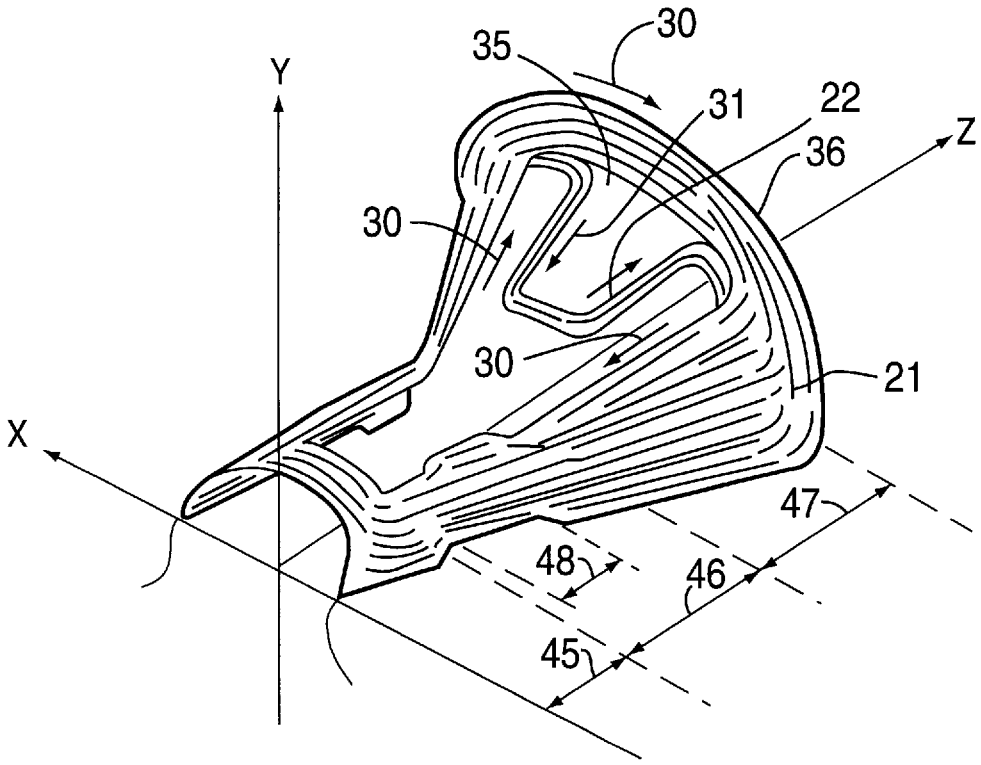

In another embodiment, represented in FIG. 10, the coil 22 creating a magnetic field opposing that of the main coil 21 consists of conductors of the main coil, wound in such way that they open a window 35 in the crown 36 of the main winding, this window extending inwards on the coil 21; that being so, the current flows in the opposite direction 30 and 31 in the two winding parts 21 and 22.

Another way of implementing the principle of the invention is to use an auxiliary coil 22 the conductors of which are short-circuited on themselves. Thus, the magnetic field created by the main coil 21 induces a current in the auxiliary coil which tends to oppose the variation in flux seen by this coil 22. Thus, in the strands of the coil 22, a current appears in the opposite direction to that flowing in the coil 21. This embodiment allows a larger correction of the NORTH/SOUTH geometry than in the case in which the coils 21 and 22 are in series, since the current induced reaches a larger value than that of the current flowing in the main coil. Moreover, this type of construction makes it possible to simplify the wiring of the coils 21 and 22, and avoids routing wires subjected to high voltages such as the horizontal scan flyback voltage. Finally, in this case, the apparent L/R ratio is enhanced, the short-circuited turns no longer being taken into account in the resistance of the yoke. The following table compares the series mounting of the coils 21 and 22 with this embodiment, the coils 21 and 22 being identical in both cases, the deflection device equipped with these coils being adapted to the same previously described ZENITH tube; the measurements were performed at a frequency of 32 kHz, an anode voltage of 28 kV and a deflection angle of 77°:

| COIL 22 IN SERIES WITH 21 | COIL 22 SHORT-CIRCUITED |
|---|---|
| L = 102.4 $\mu$H | L = 105.6 $\mu$H |
| R = 0.227Ω | R = 0.184Ω |
| L/R = 451 $\mu$s | L/R = 544 $\mu$s |
| Isc = 12.6 A | Isc = 12.65 A |

We claim:

1. Deflection device for a cathode-ray tube with three coplanar guns, comprising a pair of horizontal deflection coils and a pair of vertical deflection coils, each horizontal deflection coil having deflection winding extending over the length of the deflection device, each main deflection winding having a front portion and a rear portion, and an auxiliary deflection winding, the auxiliary deflection winding being disposed in the front portion of the main deflection winding and arranged in such a way as to generate a magnetic field opposed to a field of the main deflection winding;

each of the auxiliary windings having conductors arranged laterally about a mean angle from a horizontal deflection axis, the mean angle varying as a function of the position of the conductors along a longitudinal axis of the deflection device; wherein in the front portion of each of the main deflection windings of the pair of horizontal deflection coils, an amplitude of the third-order harmonic of the Fourier series decomposition of the angular distribution of the ampere-turn density is substantially equal to or greater than that of the fundamental.

2. Deflection device according to claim 1, characterized in that the conductors of the auxiliary winding are arranged laterally around a mean angle chosen to be between 55° and 60°.

3. Deflection device according to claim 1, characterized in that the value of the mean angle about which the conductors of auxiliary winding are arranged increases in proportion to the distance from the front part of this winding.

4. Deflection device according to preceding claim 1, characterized in that the majority of the conductors of the auxiliary winding are arranged laterally in an angular position lying between 54° and 90°0.

5. Deflection device according to claims 1, 2, 3, or 4 characterized in that a part of the conductors of the main deflection winding, being situated in a portion of the main deflection winding that is midway between the front and rear portions is offset inwards on the windings.

6. Deflection device according to claims 1, 2, 3, 4 or 5, characterized in that the conductors of the auxiliary winding are short-circuited with themselves.

7. Deflection device for a cathode-ray tube with three coplanar guns, comprising:

a pair of vertical deflection coils;

a pair of horizontal deflection coils, each horizontal deflection coil having a main deflection winding extending over the length of the deflection device and an auxiliary deflection winding, each main deflection winding having a front portion and a rear portion, the auxiliary deflection winding being disposed in the front portion of the main deflection winding;

each of the auxiliary windings having conductors arranged laterally about a mean angle from a horizontal deflection axis, the mean angle varying as a function of the position of the conductors along a longitudinal axis of the deflection device.

8. Deflection device for a color cathode-ray tube with three electron beams, comprising:

a pair of vertical deflection coils;

a pair of horizontal deflection coils, each horizontal deflection coil having a main deflection winding for generating a main magnetic field and an auxiliary deflection winding for generating higher-order harmonics of the Fourier series decomposition of the angular distribution of the ampere-turn density in the main deflection field, the auxiliary deflection winding having conductors being arranged laterally about a mean angle from a horizontal deflection axis, the mean angle varying as a function of the position of the conductors along a longitudinal axis of the deflection device, to adjust a percentage of the higher-order harmonics in order to adjust geometry and convergence.

* * * * *